United States Patent [19]

Glenn

[11] Patent Number: 5,015,508

[45] Date of Patent: May 14, 1991

[54] METHODS OF AND A DEVICE FOR CAUSING A FLUID TO BE MOVED INTO ENGAGEMENT WITH A MOVING ELONGATED MATERIAL

[75] Inventor: Jerry L. Glenn, Omaha, Nebr.

[73] Assignee: AT&T Bell Laboratories, Murray Hill, N.J.

[21] Appl. No.: 398,810

[22] Filed: Aug. 25, 1989

[51] Int. Cl.[5] ..... B05D 1/02

[52] U.S. Cl. ..... 427/424; 118/314; 118/315; 118/325; 34/23; 34/33; 34/148; 34/152; 427/372.2; 427/398.3

[58] Field of Search ..... 427/372.2, 398.3, 424; 118/314, 315, 325, 718; 34/23, 33, 57 D, 57 E, 148, 152, 155; 15/306 A; 134/122 R, 199; 68/6, 205 R

[56] References Cited

U.S. PATENT DOCUMENTS

| | | | |
|---|---|---|---|
| 3,270,364 | 9/1966 | Steele | 15/309.1 |
| 3,945,623 | 3/1976 | Gaudilliere et al. | 134/122 R |
| 4,033,785 | 7/1977 | Gibbs | 134/15 |
| 4,064,884 | 12/1977 | Asp | 134/122 R |
| 4,067,211 | 1/1978 | von der Eltz | 68/205 R |
| 4,106,519 | 8/1978 | Jalil et al. | 134/122 R |
| 4,136,527 | 1/1979 | Käding | 134/122 R |
| 4,474,830 | 10/1984 | Taylor | 427/54.1 |
| 4,811,748 | 3/1989 | Murao et al. | 134/199 |
| 4,877,645 | 10/1989 | Bleich et al. | 427/424 |

FOREIGN PATENT DOCUMENTS

| | | | |
|---|---|---|---|
| 825671 | 4/1981 | U.S.S.R. | 134/122 R |

*Primary Examiner*—Norman Morgenstern
*Assistant Examiner*—Terry J. Owens
*Attorney, Agent, or Firm*—E. W. Somers

[57] ABSTRACT

Following the application of plastic extrudate to transmission medium being moved along a path of travel to provide an insulative covering, the covered medium is moved through a cooling medium and then through an air wipe device (20). The air wipe device, which is effective to remove any of the cooling medium remaining on an outer surface of the cover, comprises a helically extending manifold (42). Spaced along inner surfaces (51, 52) of the manifold are a plurality of sets of orifices (50—50) from which air is directed into engagement with the moving transmission medium. Each set of orifices is arranged to direct streams of air toward the path of travel and hence into engagement with the transmission medium in a manner such that cooling medium is removed from the entire outer surface of the transmission medium. Also each set of orifices is such that the air which is directed toward the moving transmission media does not reengage the air wipe device. A plurality of single orifices (60—60) alternate with the sets of orifices and cooperate with the sets to maintain the transmission medium disposed along the path of travel substantially adjacent to the focal point of the streams of air from each set of orifices.

30 Claims, 3 Drawing Sheets

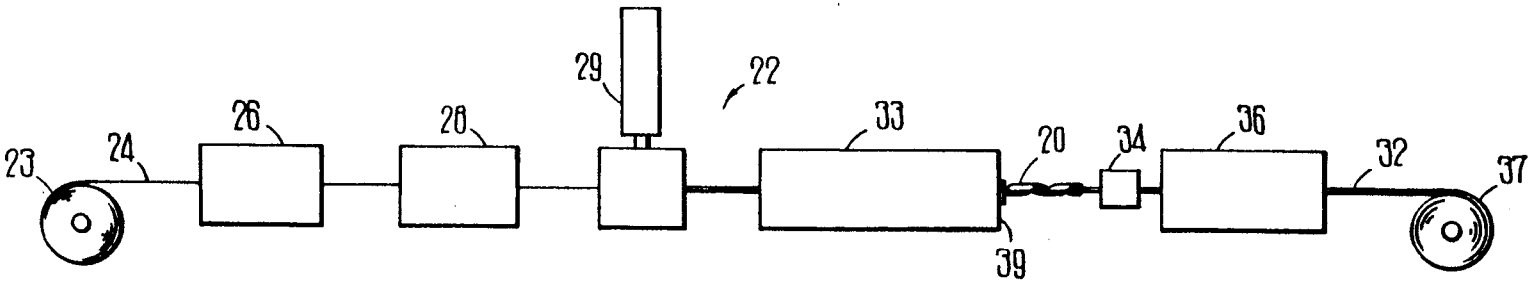
FIG 2
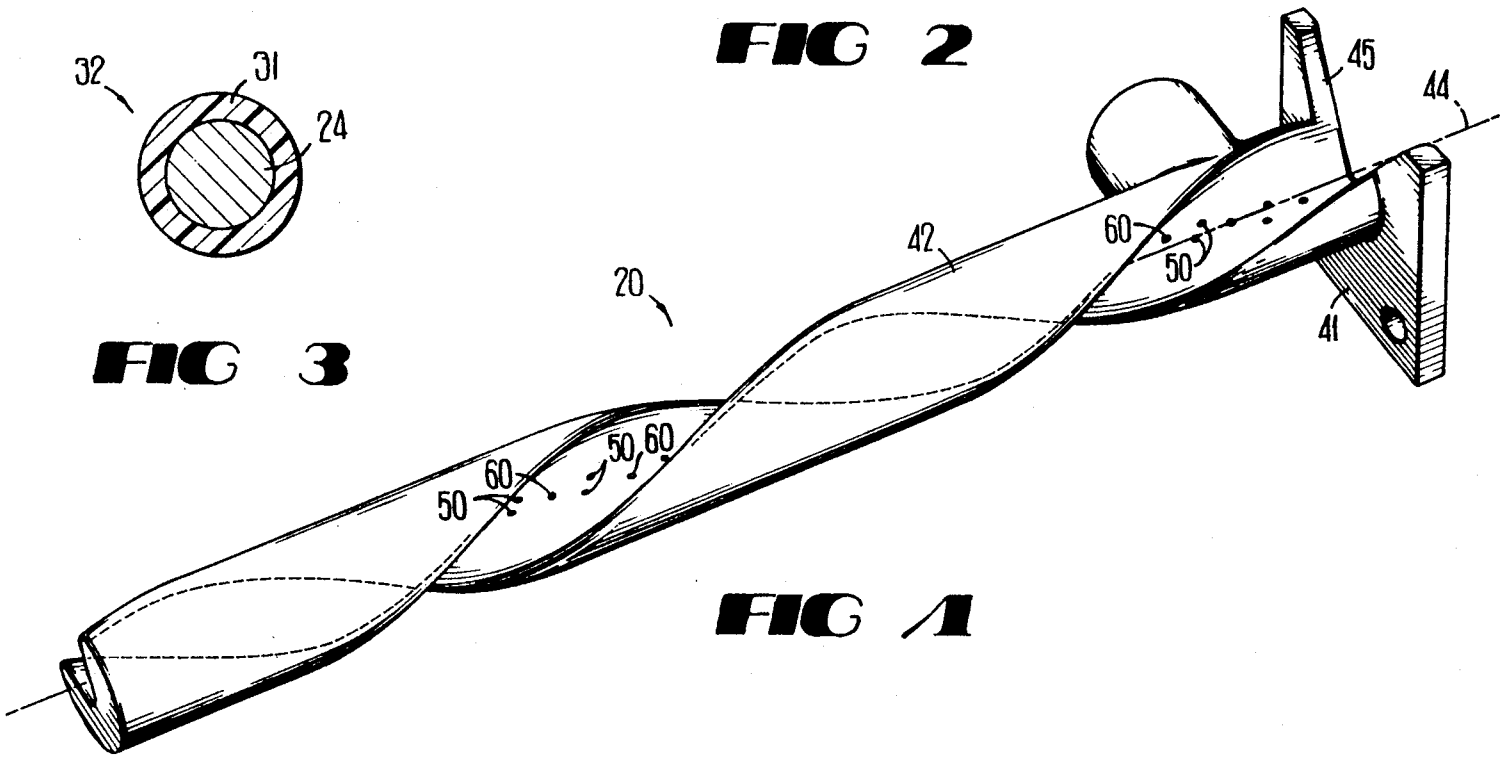
FIG 1
FIG 3

METHODS OF AND A DEVICE FOR CAUSING A FLUID TO BE MOVED INTO ENGAGEMENT WITH A MOVING ELONGATED MATERIAL

TECHNICAL FIELD

This invention relates to methods of and a device for causing a fluid to be applied to a surface of a moving elongated material. More particularly, the invention relates to methods of and an air wipe device for removing cooling liquid from an outer surface of plastic insulation material which has been applied to a moving transmission medium.

BACKGROUND OF THE INVENTION

In the manufacture of transmission media for communications purposes, for example, an elongated transmission medium is moved along a path of travel and has an insulative cover applied thereto. Typically, the cover comprises a plastic extrudate. After the application of the cover, the insulated medium is moved through a cooling device wherein a cooling medium is applied to the insulated medium to cool the material comprising the cover. Following the cooling step, cooling medium remaining on the cover is removed prior to measurements and takeup. The transmission medium may be a metallic conductor such as a copper conductor, for example. Or, the transmission medium may be an optical fiber which has been provided with one or more coating materials following draw. See for example, U.S. Pat. No. 4,474,830 which issued on Oct. 2, 1984 in the name of Carl R. Taylor.

Typically, the insulated transmission medium is moved through a device called an air wipe. In the air wipe device, jet streams of air are directed into engagement with the insulative covering material. It is commonplace for the air wipe device to comprise a tube through which the transmission medium is advanced. Air introduced into the tube travels along the tube and exits with portions of the transmission medium.

There appear to be several categories of air wipe devices in the prior art. A first type relies on a relatively expensive opening and closing mechanism to facilitate string-up. Experience has shown that these are troublesome to maintain and require excessive time to string-up.

In order to control the position of the transmission medium in the tube, it is typical to provide a contacting ceramic bearing at an entrance to the air wipe device to position the transmission medium at an entrance to the tube. One problem with the ceramic entry positioning bearing relates to irregularities in the insulation cover. Should there be any lumps, for example, in that cover, passage through the close fitting bearing may be impeded and a break in the transmission medium may occur. In a third commonly used air wipe device, spring-loaded elements are used to allow the size of the passageway opening to be changed. This arrangement does not allow the passage of lumps of plastic material at relatively high line speeds and the impact of the lumps of plastic material on portions of the air wipe device togther with friction forces may cause the filamentary material to break.

Arrangements other than those just described have been sought after. First, the prior art air wipe devices are relatively expensive and the ceramic bearing portions thereof require periodic maintenance and/or replacement. Further, for product quality reasons, it would be more desirable not to have a bearing surface contact the moving transmission medium. Clearly, what is needed is an air wipe device which accommodates such irregularities while satisfying the seemingly opposing need of centering the transmission medium during its passage through the air wipe device.

Another feature which has long been sought after is ease of string-up. In those air wipe devices which are available commercially today, it is necessary to thread the transmission medium through the bearing and the tube, or to open and close a hinged device. This is somewhat time consuming and must be done while stringing up the elongated material through other apparatus of the insulating line. What is needed is an air wipe device which is capable of relatively rapid string-up and which cannot be left ineffectively open as in the case of the hinged devices.

Efficiency of the air wipe device is another consideration. In at least some air wipe devices available commercially today, the jet streams of air, as they enter the tube through which the elongated material is being moved, are opposed to each other. As a result, some portions of the moving transmission medium are not exposed directly to an air stream emanating from a jet orifice. In other words, there are so-called dead spots on the moving elongated material, that is portions of the surface area which are not exposed to the wiping fluid. As a result, the efficiency of known prior art air wipe devices is not as high as might be expected.

What is needed and what seemingly is not provided in the prior art is an air wipe device having relatively high efficiency and being non-contacting. The sought after arrangement should be one which is low in initial cost and in maintenance. Further, it should allow the passage therethrough of any expected projection of the insulation cover material.

SUMMARY OF THE INVENTION

The foregoing problems of prior art air wipe devices have been overcome with the methods and device of this invention. In accordance with this invention, a method of causing a fluid to be applied to an elongated material comprises the steps of causing a plurality of orifices to open to a helically extending surface. The orifices are disposed along and spaced from a portion of a path of travel with each successive orifice being displaced circumferentially from the preceding pair. Relative movement is caused between the orifices and an elongated material along the path of travel. A fluid is caused to be supplied to the orifices which cause the fluid to be applied to an outer surface of the elongated material.

In order to remove liquid from an outer surface of an elongated material such as an insulated conductor, for example, the elongated material is advanced along a path of travel. Along a portion of the path of travel, the elongated material is enclosed partially by a manifold member which extends helically about and which is spaced from the path of travel. In a preferred embodiment, the manifold member has a plurality of pairs of orifices spaced therealong. The pairs of orifices are connected to a source of a fluid medium. From the pairs of openings, jet streams of the fluid medium are directed in such a manner that each pair have a point of confluence substantially adjacent to the path of travel. Further, the jet streams are disposed and the helically extending member is such that the fluid medium being directed from each orifice does not thereafter engage a portion of the member, thereby preventing loss in efficiency. In the preferred embodiment, single orifices alternate with the pairs of orifices.

BRIEF DESCRIPTION OF THE DRAWING

Other features of the present invention will be more readily understood from the following detailed description of specific embodiments thereof when read in conjunction with the accompanying drawings, in which:

FIG. 1 is a perspective view of an air wipe device of this invention;

FIG. 2 is a schematic view of a manufacturing line which includes the air wipe device of FIG. 1;

FIG. 3 is an end view of a representative covered transmission medium which is manufactured by the line of FIG. 2;

DETAILED DESCRIPTION

Figure 4:
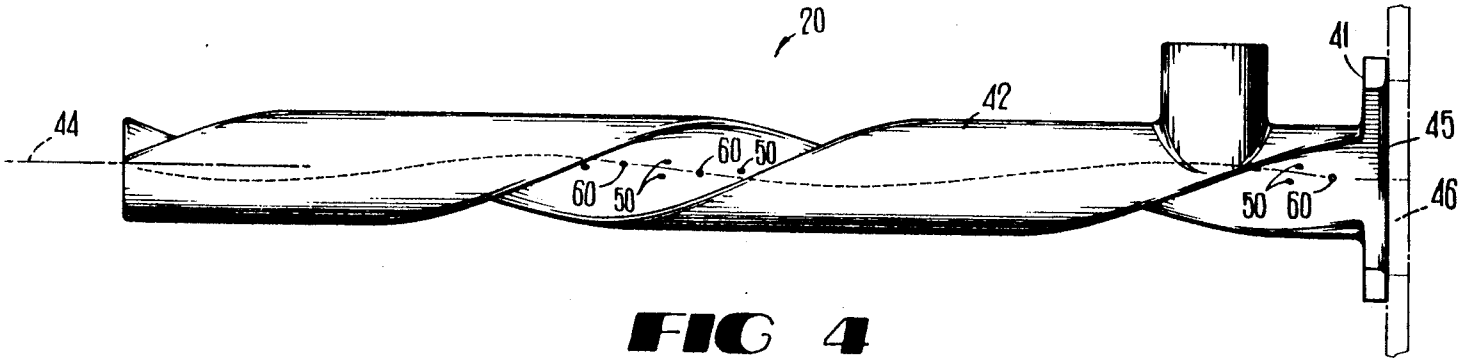
FIG. 4 is an elevational view of the air wipe device of FIG. 1.

Referring now to FIG. 1 there is shown an air wipe device designated generally by the numeral 20. The air wipe device 20 is adapted to be used on a manufacturing line 22 (see FIG. 2) which is used to manufacture transmission media which may be provided with an insulation cover or to provide a jacket for a core comprising at least one transmission medium which is provided with a protective cover.

As can be seen in FIG. 2, the manufacturing line 22 includes a supply reel 23 of a metallic conductor 24, for example (see FIG. 3). The metallic conductor 24 is payed off the supply reel, moved along a path of travel and passed through an annealer 26 and preheater 28. Afterwards, the metallic conductor 24 is passed through an extruder crosshead 29 wherein a plastic insulation material is applied to the conductor in the form of a cover 31 to provide an insulated conductor 32. The insulated conductor is moved into and through a trough 33 which holds a cooling medium such as water, for example, and thence past measurement apparatus 34 and through a capstan 36 onto a takeup reel 37. Of course, it should be realized that although the invention is being described with respect to an insulating line for a metallic conductor, the invention may be used on a jacketing line or on a line for the plastic covering of optical fiber or for the jacketing of a plurality of optical fibers, or on lines for the manufacture of plastic or fiber or metallic elongated materials.

Before the insulated conductor 32 is moved past the measurement apparatus or through the capstan, excess cooling medium must be removed from the surface thereof. This is accomplished by advancing the insulated conductor 32 through the air wipe device 20 which may be mounted adjacent to the downstream or exit end 39 of the cooling trough 33.

Figure 6:
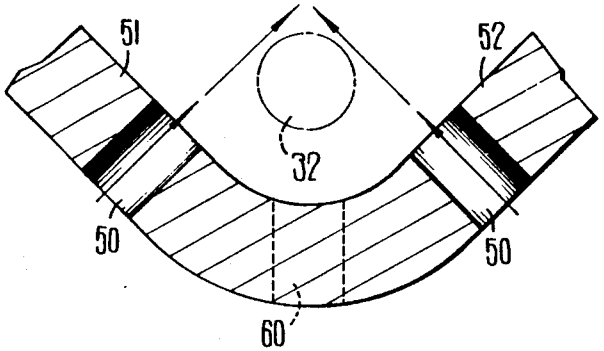
FIG. 6 is an enlarged view of a set of orifices of the air wipe device of FIG. 1.
Figure 5:
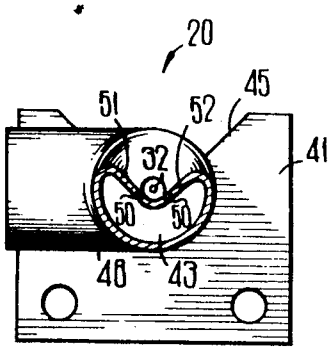
FIG. 5 is an end view of the air wipe device of FIG. 1.

Referring again to FIG. 1 and also to FIGS. 4–6, it can be seen that the air wipe device 20 comprises a flange 41 and a helically extending manifold 42. The manifold 42 may be made of a corrosion-resistant material such as stainless steel. As can be seen in FIG. 1, the flange 41 is provided with a cutout 45 which facilitates string-up.

The manifold 42 extends helically about and is spaced from a longitudinal axis 44 of the device. The manifold 42 includes a chamber 43 which is adapted to allow a drying fluid to be flowed from an input 46 throughout its length. In a section transverse to the longitudinal axis 44, the manifold appears as shown in FIG. 5. Generally, it comprises an arcuate wall 48 and two linear walls 51 and 52. The linear walls 51 and 52 are approximately normal to each other.

In order to dispense the drying fluid into engagement with the moving elongated material, the manifold 42 is provided with a plurality of pairs of orifices 50—50 spaced longitudinally along the manifold. As can be seen in FIG. 6, each pair of orifices 50—50 is such that one orifice opens from one of the two perpendicularly oriented linear walls 51 and 52 and the other orifice of each pair from the other one of the linear walls. The orifices 50—50 of each pair are arranged to direct a jet stream of the drying fluid toward the moving elongated material. Further, the orifices 50—50 of each pair are arranged so that the jet streams from the orifices associated with each pair intersect generally in the vicinity of the elongated material.

In some prior art air wipe devices, it has been commonplace for opposing jet streams of drying fluid to be dispensed from a walled cylindrical chamber toward a moving elongated material. Each jet stream generally is directed from one side of the wall and engages the other side of the wall. In the device 20 of this invention, the pairs of orifices 50—50 are arranged with respect to the helically extending manifold 42 such that each jet stream directed from a wall of the manifold does not thereafter engage the helically extending wall of the manifold. Rather, each orifice directs a stream of drying fluid to cause portions of the drying fluid to engage the surface of the moving elongated material after which the drying fluid is dissipated into the ambient atmosphere, or optionally into an external cover, thereby preventing efficiency loss by recontamination of the elongated material.

Within the prior art, because of opposed jet arrangements, it was commonplace for portions of the traveling elongated material not to be exposed to the drying fluid. On the other hand, with the arrangement of this invention, the moving elongated material, that is the insulated conductor 32, is subject to a plurality of pairs of jet streams which effectively rotate about the elongated material in a helical manner along a length thereof. As a result, complete coverage of the elongated material is achieved.

In a preferred embodiment of this invention, the manifold 42 also is provided with a second plurality of orifices 60—60 (see again FIGS. 1, 4 and 6). The second plurality comprises a single row of orifices extending in a direction parallel to the longitudinal axis 44 of the air wipe. Each of the orifices 60—60 is formed at the confluence of the two linear walls 51 and 52 (see FIG. 6). Further, the orifices 60—60 alternate with the pairs of orifices 50—50.

The orifices 50—50 and 60—60 cooperate to provide effectively an air bearing for the moving elongated material. The fluidic air bearing is effective to maintain the elongated material disposed along a path of travel which is adjacent to the locii of the intersection points of the orifices 50—50 of each of the pairs. As a result, complete exposure of the outer surface of the elongated material is achieved as it is moved through the air wipe device 20.

The air wipe device 20 of this invention is advantageous over the prior art in several respects. First, it has no moving parts. Secondly, it removes cooling medium from the elongated material in a way so that there are no unexposed spots on the elongated material. All portions thereof are exposed to the drying fluid in what can be viewed as a spiraling pair of jet streams along a length of the elongated material. Thirdly, the device is more efficient than those of the prior art. In a test designed to measure how much of the cooling medium on a length of the elongated material is collected with a prior are device and with the device 20, it was determined that the latter's efficiency was about 96% as compared to about 86% with that of the most efficient prior art.

Further, the device of this invention simplifies string-up. In fact, the device 20 may be positioned on the manufacturing line after the elongated material has been strung up. A manufacturing line operator need only turn the elongated material into the device to achieve string-up of the elongated material through the device.

A still further advantage is that the device is non-contacting with the elongated material. The air bearing arrangement provided by the series of pairs of jet streams focus generally on the moving elongated material and maintain the elongated material out of contact with surfaces of air wipe device 20. As a result, the possibility for damage to the elongated material and for wear of the device are avoided.

Also, the efficiency performance level of the air wipe device 20 of this invention provides other benefits. For example, product quality is improved. Also, a reduced noise level which is helpful from an environmental standpoint and reduced air pressure have been achieved. Reduced air pressure results in less air required, leading to lower manufacturing costs.

Figure 7:
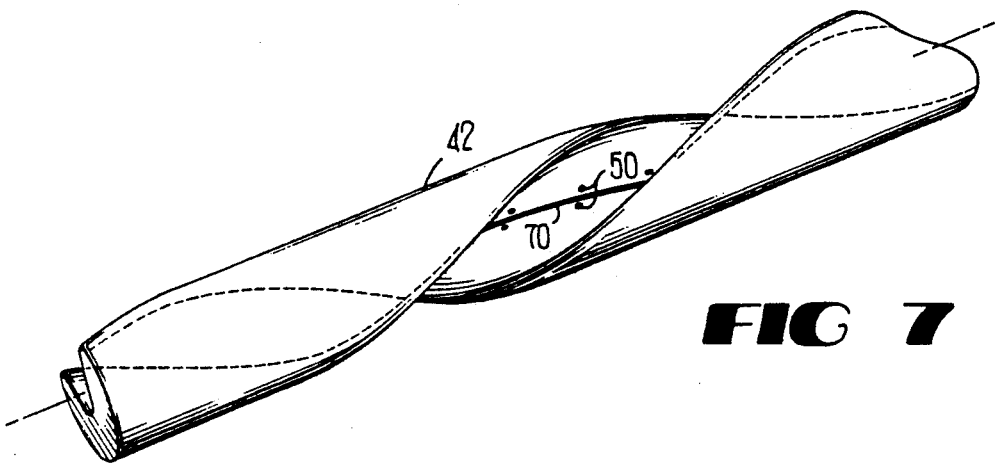
FIGS. 7–9 are views of alternative embodiments of the invention.

Embodiments other than the preferred described hereinbefore are included in the scope of the invention. For example, instead of a row of single orifices 60—60 which alternate with the pairs of orifices 50—50, a slotted opening 70 (see FIG. 7) which extends along the manifold member 42 may be used. The slotted opening 70 extends helically and is caused to be disposed along the intersection of the two linear walls 51 and 52 which define the chamber 43.

Figure 8:
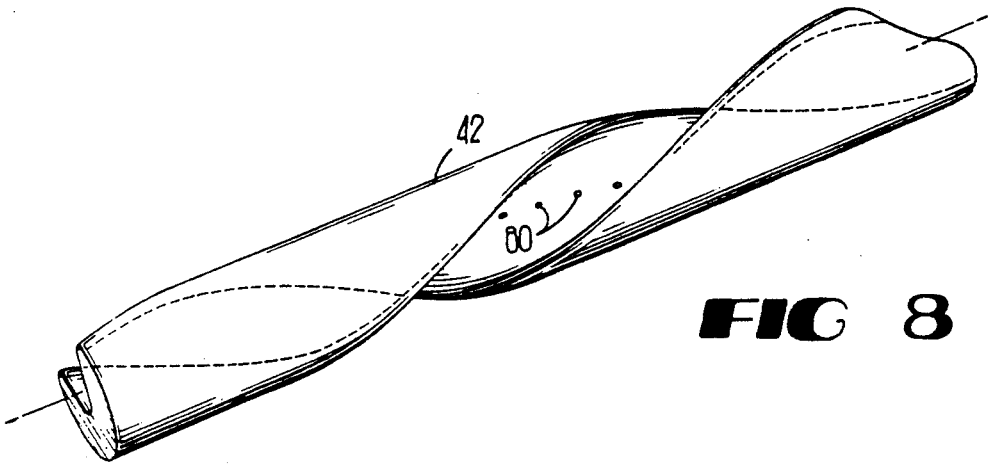

Depicted on FIG. 8 is another alternative embodiment. Therein, a fluid is discharged in jet streams into engagement with the moving elongated material through a row of single orifices 80—80. The orifices 80—80 are disposed generally along the intersection of the two linear portions 51 and 52 of the helically extending manifold 42.

Figure 9:
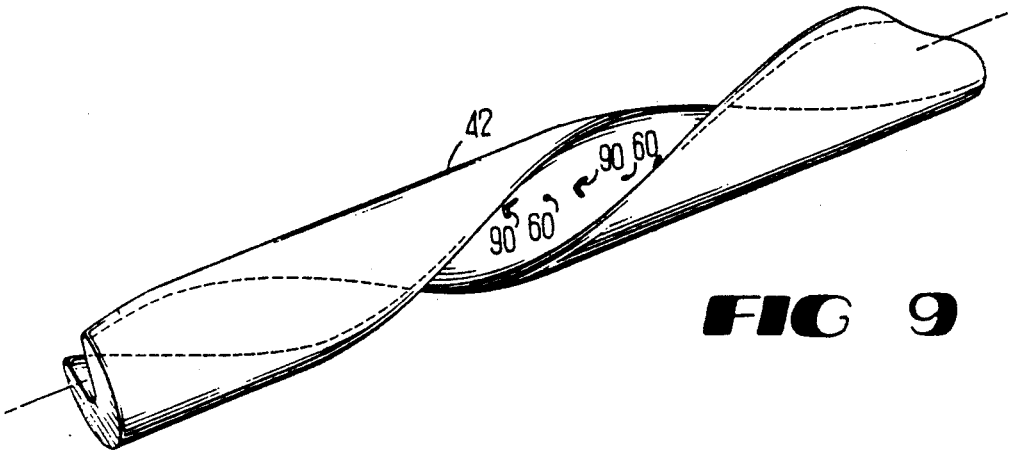

In a still further embodiment (see FIG. 9), fluid is discharged from the chamber 43 into engagement with the moving elongated member through a plurality of generally V-shaped slotted orifices 90—90 which are spaced along the path of travel. Each V-shaped orifice 90 extends along a portion of the linear wall 51 of the manifold member, along a portion of the wall 52 and through the intersection of those two wall portions.

It should be realized that whereas the invention has been described in terms of the removal of cooling liquid from the surface of a moving elongated material, other uses may be made of the invention. For example, the methods and devices of this invention may be used to remove plating solution or a lubricant from the surface of a substrate, or used to apply a fluid to moving elongated material for any of many different purposes such as, for example, coating.

It is to be understood that the above-described arrangements are simply illustrative of the invention. Other arrangements may be devised by those skilled in the art which will embody the principles of the invention and fall within the spirit and scope thereof.

I claim:

1. A device for causing a fluid to be moved into engagement with elongated material, said device including:

a manifold member having an input port and being wrapped helically about and being spaced from a longitudinal axis with longitudinally aligned increments of length of successive convolutions of the helically wrapped manifold member being spaced apart in a direction parallel to the longitudinal axis;

means connected to said input port of said manifold member for providing a fluid to said manifold member; and means for causing relative motion between said manifold member and an elongated material;

said manifold member including means for directing the fluid into engagement with the elongated material simultaneously at spaced locations along the length of the elongated material.

2. A device for removing a liquid material from an outer surface of elongated material, said apparatus comprising:

a manifold member having an input port and extending helically about and spaced from a longitudinal axis such that longitudinally aligned increments of length of successive convolutions of the helically extending manifold member are spaced apart;

means connected to said input port of said manifold member for providing a fluid to said manifold member; and moving means for causing relative motion between said manifold member and an elongated material extending through said manifold member and having a material on an outer surface thereof which is to be removed from the outer surface;

said manifold member including means for directing streams of fluid into engagement with the elongated material simultaneously at spaced locations along the length of the elongated material to remove liquid material from an outer surface of the elongated material.

3. The device of claim 2, wherein said manifold member includes a plurality of pairs of orifices each adapted to have a stream of fluid associated therewith, each pair of orifices being disposed in a plane which is substantially transverse to said longitudinal axis of said manifold member, with an axis of each stream extending from an associated orifice past the elongated material without thereafter engaging said manifold member.

4. The device of claim 3, wherein each pair of orifices are arranged so that streams of fluid being directed therefrom converge in the vicinity of the elongated material.

5. The device of claim 4, wherein said moving means causes the elongated material to be moved along a path of travel which extends through said manifold member generally parallel to the longitudinal axis, the streams of fluid being directed from said plurality of pairs of orifices being effective to cause the elongated material to be maintained substantially along the path of travel.

6. The device of claim 5, wherein said pairs of orifices are disposed along said manifold member such that a stream directed from each orifice of each pair is directed into ambient atmosphere along a path which does not engage said manifold member.

7. The device of claim 5, wherein each said orifice has a circular configuration.

8. The device of claim 5, wherein each said orifice has a slotted configuration.

9. The device of claim 5, which also includes a plurality of single orifices which alternate with said sets of orifices, each of which is adjacent to at least one of said sets of orifices and being directed toward a line which extends through the intersection of the streams directed from the pairs.

10. The device of claim 9, wherein each of said orifices of each pair opens to a surface of said manifold member which surface faces toward the elongated material, each of said single orifices being disposed along a line which extends through the intersection of the two surfaces.

11. The device of claim 3, wherein said manifold has a cross section transverse to the longitudinal axis which is bounded by an arcuate portion and two intersecting linear portions.

12. The device of claim 11, wherein each one of said pair of orifices opens to a surface of one of said intersecting linear portions.

13. The device of claim 12, wherein said means for directing streams includes a longitudinally extending slot, said longitudinally extending slot being disposed generally along the intersection of said two linear portions.

14. The device of claim 2, wherein said manifold has a cross section transverse to the longitudinal axis which is bounded by an arcuate portion and two intersecting linear portions.

15. The device of claim 14 wherein said means for directing streams includes a plurality of slotted orifices spaced along the longitudinal axis, each of said slotted orifices extending from one of the linear portions into the other linear portion.

16. The device of claim 14, wherein said means for directing streams includes a plurality of orifices which are spaced along said manifold member and which are disposed generally along the intersection of said two linear portions.

17. An apparatus for making an insulated transmission medium, said apparatus including:

means for supplying a transmission medium;

moving means for advancing the transmission medium along a path of travel;

means for applying a covering material to the transmission medium;

means for applying a cooling medium to the covering material;

wiping means for removing cooling medium from an outer surface of the covering material, said wiping means including the device of claim 2; and means for taking up the covered transmission medium.

18. A method of causing a fluid to be moved into engagement with elongated material, said method comprising the steps of:

causing a plurality of orifices to be disposed in successive planes along a portion of an axis with each orifice being spaced from the axis, with each orifice in each successive plane being displaced rotationally from an orifice in a preceding plane and with each orifice opening to a surface which extends helically about the axis;

causing relative movement between said orifices and an elongated material along the axis; and causing a supply of a fluid to be supplied to the orifices to cause the orifices to apply fluid to an outer surface of the elongated material.

19. A method of removing a liquid material from an outer surface of elongated material, said method comprising the steps of:

causing a plurality of orifices to be disposed in successive planes along a portion of an axis with each orifice being spaced from the axis, with each orifice in each successive plane from the axis, with each orifice in each successive plane being displaced rotationally from an orifice in a preceding plane and with each orifice opening to a surface which extends helically about the axis;

causing relative movement between the orifices and an elongated material along the axis; and causing a supply of a fluid to be supplied to the orifices to cause the orifices to apply jet streams of the fluid to an outer surface of the elongated material to remove a liquid material therefrom.

20. The method of claim 19, wherein a pair of orifices are caused to be provided in each plane.

21. The method of claim 20, wherein each of the jet streams is directed from a circular opening.

22. The method of claim 20, wherein each of the jet streams is directed from a slotted opening.

23. The method of claim 20, wherein the jet streams of each pair are directed to intersect at a point generally in the vicinity of the path of travel.

24. The method of claim 23, wherein one of each pair of orifices opens to a first surface and the other one of each pair opens to a second surface which intersects said first surface.

25. The method of claim 24, wherein single jet streams alternate with the pairs of jet streams.

26. The method of claim 25, wherein each single jet stream is disposed along a line of intersection of said first and second surfaces.

27. The method of claim 26, wherein said jet streams are effective to cause the elongated material to be maintained by fluid bearing effect along the path of travel which is at least adjacent to a line which passes approximately through the points of intersection of the jet streams.

28. The method of claim 19, wherein the fluid is caused to be discharged from a plurality of slotted orifices spaced along the path of travel, each of the slotted orifices extending from one linear surface to another linear surface disposed at an angle to the one surface.

29. The method of claim 19, wherein the fluid is caused to be discharged from a plurality of orifices which are spaced along the path of travel and which are disposed along the intersection of two linear helically extending surfaces.

30. A method of making an insulated transmission medium, said method comprising the step of moving a transmission medium along a path of travel, applying a covering material to the transmission medium, applying a cooling medium to the covering material, removing the cooling medium from an outer surface of the covering material by the steps of claim 19 and taking up the covered transmission medium.

* * * * *